United States Patent [19]

Morgan

[11] 4,438,636

[45] Mar. 27, 1984

[54] HEAT-ACTUATED AIR CONDITIONER/HEAT PUMP

[75] Inventor: Dean T. Morgan, Sudbury, Mass.

[73] Assignee: Thermo Electron Corporation, Waltham, Mass.

[21] Appl. No.: 390,596

[22] Filed: Jun. 21, 1982

[51] Int. Cl.[3] ..... F25B 3/00; F25B 29/00

[52] U.S. Cl. ..... 62/325; 62/499; 165/86

[58] Field of Search ..... 165/86, 104.25, 104.21; 62/499, 325

[56] References Cited

U.S. PATENT DOCUMENTS

| | | | |
|---|---|---|---|
| 1,446,727 | 2/1923 | Smith | 62/499 X |
| 3,332,253 | 7/1967 | Alexander | 62/499 |
| 3,621,908 | 11/1971 | Pravda | 165/86 |
| 3,715,610 | 2/1973 | Brinkman | 310/54 |
| 3,808,828 | 5/1974 | Kantor | 62/499 X |
| 3,877,515 | 4/1975 | Laing | 165/86 |
| 3,882,335 | 5/1975 | Fries | 310/61 |
| 3,888,304 | 6/1975 | Laing | 165/86 |
| 3,962,874 | 6/1976 | Doerner | 165/86 X |
| 3,999,400 | 12/1976 | Gray | 62/115 |

*Primary Examiner*—Albert W. Davis, Jr.
*Attorney, Agent, or Firm*—Herbert E. Messenger

[57] ABSTRACT

A heat-actuated air conditioner/heat pump is disclosed which includes a sealed, rotatable tube. The sealed tube contains a working fluid and includes an evaporator leg and a condenser leg, the condenser leg extending a greater distance from the axis of rotation than the evaporator leg. As the tube is rotated, a vapor pressure differential is created between the evaporator and condenser legs with the higher pressure in the condenser leg. Because of this pressure differential, the working fluid will evaporate in the evaporator leg at a lower temperature than that at which it will condense in the condenser leg. The evaporator leg thus can be used for cooling a stream of house air (house air conditioning) while the condenser leg rejects heat to a stream of ambient air. When all of the working fluid has evaporated, the system may be recharged for another cooling cycle by supplying heat to the condenser leg to drive the working fluid back into the evaporator leg. The sealed tube may also be operated as a heat pump for heating house air.

9 Claims, 7 Drawing Figures

HEAT-ACTUATED AIR CONDITIONER/HEAT PUMP

BACKGROUND OF THE INVENTION

Refrigeration systems effect cooling by causing a working fluid to evaporate at a lower temperature and to condense at a higher temperature, thereby removing heat from a relatively cold region and rejecting it to a higher temperature region. Conventional refrigeration systems utilize mechanical energy input from a compressor to raise the refrigerant vapor pressure so that vapor is pulled from the evaporator liquid at a cold temperature and then is condensed at a higher temperature such as that of ambient air. Other known cooling-/refrigeration systems employ a solid or liquid adsorber or absorber to modify the conditions under which a working fluid will condense. In these systems a working fluid and a sorbent are contained within a sealed enclosure. The sorbent in effect "pulls" vapor from the working fluid at one temperature, and the vapor condenses on the sorbent at a higher temperature. Heat is subsequently used to desorb the working fluid, and thus provides the energy input required for operation of such systems.

While some of the above-described adsorber/absorber systems are available commercially, these systems are generally quite complex, utilizing pumps and many connections. This makes the required leak-tightness difficult to achieve and maintain. Also, such systems may have low coefficients of performance, particularly if solid adsorbents are employed.

It is an object of the present invention to provide an air conditioner/heat pump which is operable with heat energy input but which does not employ a sorbent material.

It is also an object of the invention to provide an air conditioner/heat pump which minimizes susceptibility to leaks and which is simple and inexpensive to manufacture.

It is yet another object of this invention to provide an air conditioner/heat pump which needs little maintenance and is very efficient.

SUMMARY OF THE INVENTION

The heat-actuated air conditioner/heat pump system disclosed herein includes at least one sealed tube having a central portion in fluid communication with a condenser leg portion and an evaporator leg portion and adapted to carry a vaporizable working fluid. This tube is supported for rotation about an axis lying substantially in the central portion. The condenser leg extends to a radius from the axis of rotation which is greater than the radius of the evaporator leg. As the sealed tube is rotated, a vapor pressure differential is produced in the condenser and evaporator legs such that evaporation of the working fluid in the evaporation leg will occur at a lower temperature than that which produces condensation of the fluid in the condenser leg. Separate flows of heated air, house air, and ambient air are selectively directed onto the condenser leg and evaporator leg of the sealed tube to either cool the house air when the system is operated as an air conditioner or to heat the house air when the system is operated as a heat pump.

In a preferred embodiment the central portion of the sealed tube is substantially straight, and the condenser and evaporator legs extend from the central portion at different radii. Two or more sealed tubes are disposed symmetrically about the axis of rotation so as to provide a dynamic balance during the rotation. Valved arrangements are provided for periodically switching the flows of heated air, house air, and ambient air being directed onto the condenser and evaporator legs of the sealed tubes in order to cycle the working fluid between the condenser legs and evaporator legs.

In another embodiment of the invention, the air conditioner/heat pump comprises two sets of sealed tubes disposed for rotation about the same axis, with one set of sealed tubes axially displaced from the other. In this embodiment continuous cooling (or heating) can be achieved because one set of tubes is used for cooling (or heating) while the other set of tubes is being recycled. This embodiment also requires no net mechanical work input except to overcome air drag and friction.

In each of the foregoing embodiments it is preferred that the working fluid have a high molecular weight. It is also preferred that the condenser and evaporator legs have an exterior configuration shaped as blower vanes or airfoils in order to produce a directed airflow during rotation.

BRIEF DESCRIPTION OF THE DRAWING

The invention disclosed herein will be better understood with reference to the following drawing in which.

DESCRIPTION OF THE PREFERRED EMBODIMENTS

Figure 1:
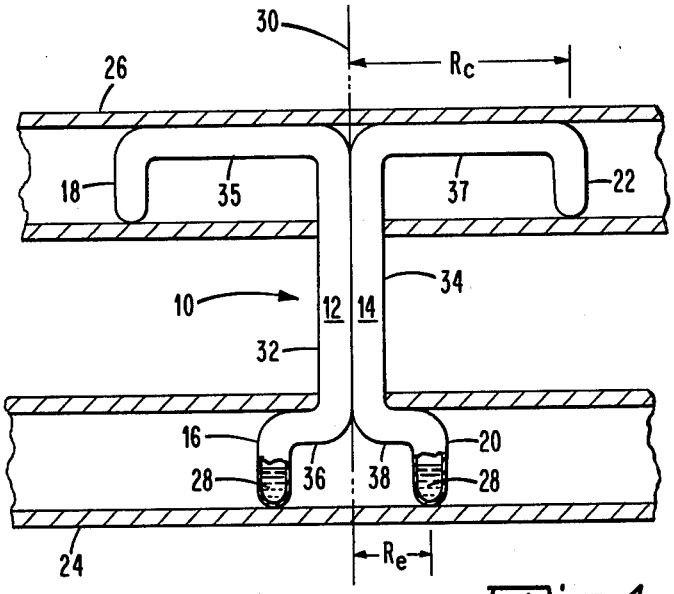
FIG. 1 is a schematic side elevation view of an embodiment of the invention disclosed herein with its heat pipes at rest (not rotating)

In FIG. 1 there is illustrated an air conditioner/heat pump assembly 10 including a pair of heat pipes 12 and 14. The heat pipe 12 has an evaporator leg portion 16 and a condenser leg portion 18. Similarly, the heat pipe 14 has an evaporator leg portion 20 and a condenser leg portion 22. The evaporator legs 16 and 20 are located within a channel 24 and the condenser leg portions 18 and 22 are located within a channel 26. The heat pipes 12 and 14 are made of a material with good heat transfer properties and adequate strength, such as stainless steel.

Although two heat pipes 12 and 14 are shown, the assembly 10 or other air conditioner/heat pump assemblies described hereinafter may include three or more heat pipes positioned essentially symmetrically about an axis of rotation.

A working fluid or refrigerant fluid 28 is sealed within each of the heat pipes 12 and 14. Among the preferred fluids are fluids in the Freon family such as Freon 114B2 which has the chemical formula $CBrF_2CBrF_2$ such fluids being readily available from E. I. DuPont De Nemours & Company of Wilmington, Del. As will be discussed below, working fluids with high molecular weights are preferred.

The heat pipes 12 and 14 are mounted by conventional means for rotation about an axis 30. Each of the evaporator legs 16 and 20 is located at a distance $R_e$ from the axis of rotation 30, and each of the condenser legs 18 and 22 is a distance $R_c$ from the axis 30. The evaporator legs 16 and 20 are in fluid communication with their associated condenser legs 18 and 22 through transition sections including central portions 32 and 34 parallel to the axis 30 and generally radially-extending arms 35, 36, 37 and 38. It is essential that the radius $R_c$ be greater than the radius $R_e$, and preferably $R_e$ is as small as possible. Selection of the radius $R_e$ is, however, also influenced by the desirability of locating the evaporator legs 16 and 20 at least a small distance radially outward of the central portions 32 and 34 of the heat pipes 12 and 14 so that transfer of the refrigerant or working fluid 28 between evaporator and condenser legs can occur only by vapor transport.

To cause cooling in the channel 24, the assembly 10 is rotated. Because $R_c$ is greater than $R_e$, as the assembly 10 rotates about the axis 30, the inertial loads at the radius $R_c$ will be greater than those at the radius of $R_e$. Because of this differential inertial loading, the vapor pressure within the condenser leg portions 18 and 22 will be higher than the pressure in the evaporator legs 16 and 20. With a suitable pressure differential, the working fluid 28 evaporates and the resulting vapor travels from the evaporator legs to the condenser legs.

Figure 2:
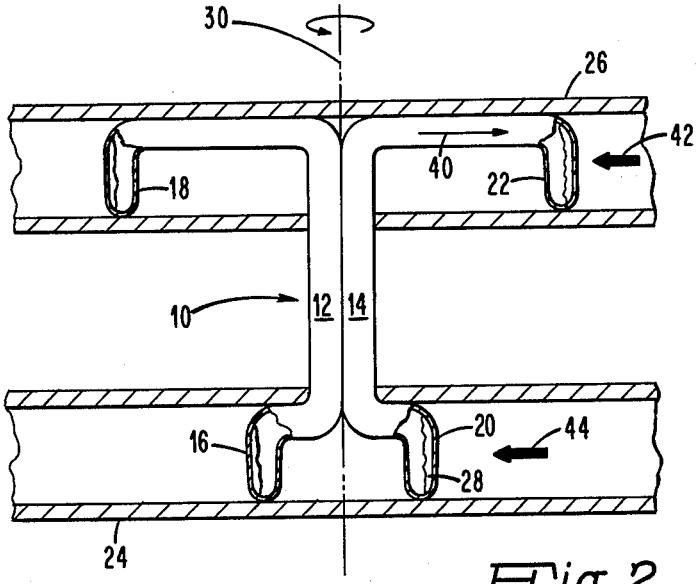
FIG. 2 is a schematic side elevation view of the embodiment of FIG. 1 during cooling operation.

With reference now to FIG. 2, which shows the assembly 10 rotating about the axis 30 during cooling operation, an arrow 40 indicates that vapor is traveling from the evaporator legs 16 and 20 to the condenser legs 18 and 22. The channel 26 carries air at ambient temperature and moving in the direction of an arrow 42. The channel 24 contains a moving stream of cooler air from, for example, a dwelling house, which is to be cooled. This house air is moving as indicated by an arrow 44. Preferably the exterior surfaces of the evaporator legs 16 and 20 and the condenser legs 18 and 22 are shaped to function similar to blower vanes so that rotation of the heat pipe moves air through the ducts 24 and 26 without the requirement for separate blowers.

Heat removed from the air in the channel 24 is absorbed by the working fluid 28 as it changes from the liquid to the vapor state. This heat is given up as the vapor condenses back into the liquid state in the condenser legs 18 and 22 and is rejected into the ambient air flowing in the channel 26. Thus, evaporation at a lower temperature is coupled with condensation at a higher temperature to effect the desired cooling in the channel 24. It is thus seen that the compressor in mechanical refrigeration systems and the adsorber material in known heat actuated systems are eliminated, the rotationally induced inertial loads effecting the required pressure differential so that the working fluid evaporates at a lower temperature and condenses at a higher temperature.

The assembly 10 continues to cool house air until all of the working fluid 28 has evaporated from the evaporator legs and condensed in the condenser legs. At this point, the system must be recycled to its initial conditions so that further cooling can be accomplished.

Figure 3:
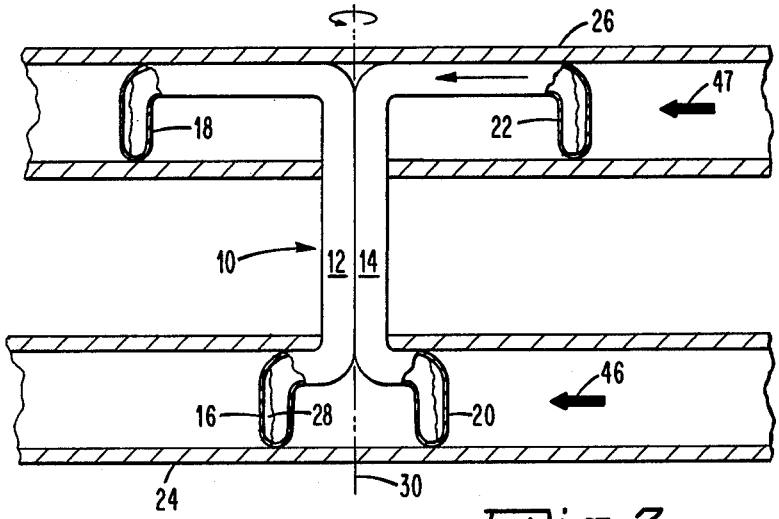
FIG. 3 is a schematic side elevation view of the embodiment of FIG. 1 during recycling operation.

FIG. 3 illustrates the recycling operation. During the recycling operation the assembly 10 preferably continues to rotate as it did during the cooling cycle so that the assembly 10 need not be repeatedly started and stopped. The recycling operation begins by changing the airflows in the channels 24 and 26. The channel 24 is disconnected from the cooled household air by means of conventional valves (not shown). Ambient air is then directed through the channel 24 and moves, for example, in the direction of an arrow 46. Concurrently, channel 26 which had been carrying ambient air is now switched by conventional means to carry heated air from a source such as a conventional furnace or solar collectors in the direction of an arrow 47. Thus, the air in the channel 26 is hotter than the ambient air now flowing through the channel 24. Because of this temperature differential, the working fluid 28 in the condenser legs 18 and 22 is vaporized and driven back into the evaporator legs 16 and 20, where it condenses. Once all of the working fluid 28 is back in the evaporator legs 16 and 20, the cooling operation can begin once again. The channel 24 is again connected to the household air to be cooled, and the channel 26 is once again connected to outside or ambient air.

The cooling and recycling operations are continued for as long as the cooling function is desired. It should be noted that the energy which causes the cooling to occur comes from the heated air introduced into the system during the recycle operation. Thus the air conditioner described herein uses heat energy as an input rather than mechanical energy required with refrigeration systems employing compressors. It is recognized, of course, that some mechanical energy is required in rotating the assembly 10. To keep the heat pipes rotating at a constant speed, not only must air drag be overcome but also additional mechanical energy is required in the cooling operation because as the working fluid 28 moves from the evaporator legs at a distance $R_e$ from the axis 30 to the condenser legs at a radius $R_c$, its kinetic energy increases because $R_c$ is greater than $R_e$. During the recycling operation this additional mechanical energy can be recovered for use in the cooling operation, resulting in no net mechanical energy requirement for a complete cycle except that needed to overcome air drag and friction.

Figure 4:
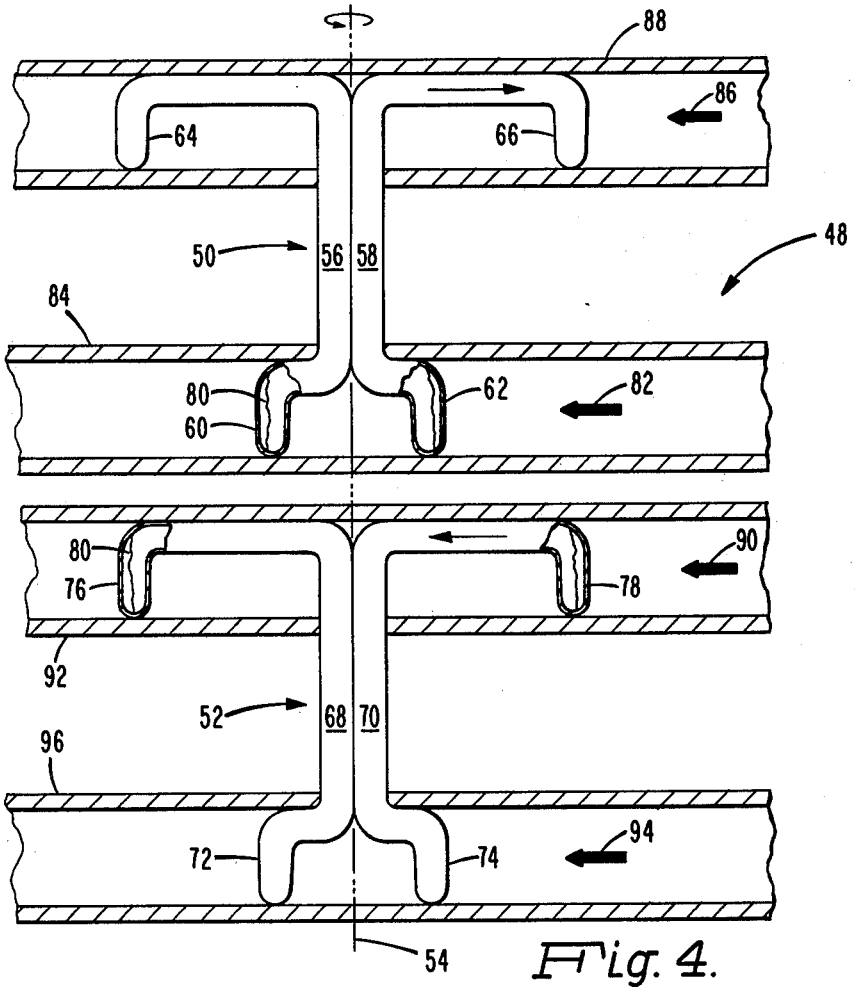
FIG. 4 is a schematic side elevation view of an embodiment of the invention including two sets of heat pipes.

An embodiment of the invention which allows continuous cooling or heating is illustrated in FIG. 4. In this air conditioning/heat pump system 48 a pair of heat pipe assemblies 50 and 52 is mounted on a common shaft for rotation about an axis 54. The assemblies 50 and 52 are substantially identical to the assembly 10 discussed with reference to FIGS. 1, 2 and 3. The assembly 50 thus includes heat pipes 56 and 58 having evaporator leg portions 60 and 62 and condenser leg portions 64 and 66. Similarly, the assembly 52 includes heat pipes 68 and 70 with evaporator legs 72 and 74 and condenser legs 76 and 78. The heat pipes of the assembly 50 and the assembly 52 contain a working fluid or refrigerant 80. As shown, the assembly 50 is operating in the cooling mode and the assembly 52 is in its recycle mode. Thus air moving in the direction of an arrow 82 in a channel 84 communicates with the house air which is to be cooled. Air moving in the direction of an arrow 86 in a channel 88 is simply ambient or outside air. Thus, as with the embodiment of FIGS. 1, 2 and 3, as the assembly 50 rotates, the working fluid 80 will evaporate from the evaporator legs 60 and 62 and condense in the condenser legs 64 and 66 which process "pumps" heat from the air in the channel 84 to the ambient air in the channel 88. While the assembly 50 is in its cooling mode, the assembly 52 is in its recycle mode. Thus, heated air from a furnace or solar collectors, moving in the direction of an arrow 90, flows through a channel 92 heating the working fluid 80 in the condenser legs 76 and 78. Cooler ambient air moving in the direction of an arrow 94 through a channel 96 causes the refrigerant 80 to condense in the evaporator legs 72 and 74. As soon as all of the refrigerant 80 has condensed in the evaporator legs 72 and 74, the assembly 52 is then ready to be put back into the cooling mode. At substantially the same time the assembly 50 will need to be placed in the recycle mode. Thus the airflows in the various channels are switched to effect the changeover. By operating the two assemblies 50 and 52 in tandem therefore, cooling or heating can be continuously effected since one or the other of the assemblies will always be in the desired mode. Also the mechanical work input to the assembly 50 is directly balanced by the mechanical work output from the assembly 52, with no net work input required except to overcome air drag and friction.

Figure 5:
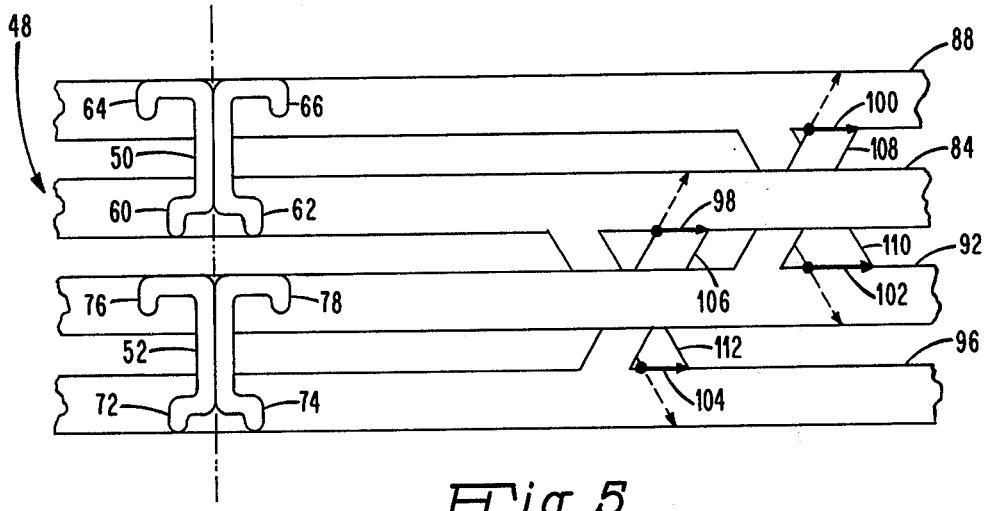
FIG. 5 is a simplified schematic view of the embodiment shown in FIG. 4 illustrating an arrangement for switching airflows between channels of the air conditioner/heat pump.

FIG. 5 is a simplified view of the embodiment shown in FIG. 4 but also illustrates valves for switching airflows between channels of the air conditioner/heat pump. The channels 84, 88, 92, and 96 contain, respectively, valves 98, 100, 102, and 104. Each valve may be switched from a position parallel to and allowing airflow through, its respective channel, to a position (shown by broken lines in FIG. 5) blocking its associated channel. In the latter position the valves 98, 100, 102, and 104 divert air through crossover pipes 106, 108, 110, and 112, each of which connects two channels, so that air flows are directed in contact with selected evaporator legs and condenser legs of the heat pipe assemblies 50 and 52.

Although not shown in FIG. 5, it is apparent that additional valves may be positioned at the exit of each channel to prevent entrainment of air from or reverse flow of air into, the channel exits when the valves 98, 100, 102, and 104 are in position parallel to the channel walls.

Table 1 lists the air streams and the various legs of the heat pipes to which these air streams are directed during operation of the system for cooling house air (air conditioning). During the air conditioning operation ambient air is introduced into the inlet end (right side of FIG. 5) of the channels 88 and 96, heated air is introduced into the inlet end of the channel 92, and house air to be cooled is introduced into the inlet end of the channel 84. In a first mode of operation, the valves 98, 100, 102, and 104 are in position parallel to the channels and the heat pipe assembly 50 cools house air while the assembly 52 recycles working fluid from its condensers 76 and 78 to their evaporators 72 and 74. At a selected time such as when all of the working fluid of the heat pipe 50 has condensed in the legs 64 and 66, the valves 98, 100, 102, and 104 are switched to the broken-line positions indicated in FIG. 5 and the system 48 is operated according to the second mode set forth in Table 1. In this mode the heat pipe assembly 52 cools house air while the assembly 50 recycles working fluid to again prepare for cooling.

TABLE 1

AIR CONDITIONER OPERATING MODES

| Heat Pipe Assembly | Legs | Mode 1 Air | Mode 2 Air |
|---|---|---|---|
| 50 | Condensers 64 and 66 | Ambient | Heated |
| 50 | Evaporators 60 and 62 | House | Ambient |
| 52 | Condensers 76 and 78 | Heated | Ambient |
| 52 | Evaporators 72 and 74 | Ambient | House |

Table 2 lists information similar to that of Table 1 for operation of the system 48 as a heat pump to heat house air. During heat pump operation house air is introduced into the inlet end of the channels 88 and 96, heated air is introduced into the inlet end of the channel 92, and ambient air is introduced into the inlet end of the channel 84.

In the first heat pump mode, the heat pipe assembly 50 circulates ambient air over the rotating legs 60 and 62 of the heat pipe assembly 50 to vaporize working fluid therein which migrates to, and condenses in, the condenser legs 64 and 66 delivering heat to the house air. At the same time heated air vaporizes the working fluid in condenser legs 76 and 78 to recycle the fluid to the evaporator legs 72 and 74 where it condenses, delivering heat to the house air flowing over the rotating legs 72 and 74. At an appropriate time the valves 98, 100, 102, and 104 may then be switched to their broken-line positions (mode 2 operation) so that the assembly 50 recycles the fluid back to the evaporators 60 and 62, and the assembly 52 extracts heat from the ambient air at the evaporator legs 72 and 74 and delivers heat to house air passing over the condenser legs 76 and 78.

TABLE 2

HEAT PUMP OPERATING MODES

| Heat Pipe Assembly | Legs | Mode 1 Air | Mode 2 Air |
|---|---|---|---|
| 50 | Condensers 64 and 66 | House | Heated |
| 50 | Evaporators 60 and 62 | Ambient | House |
| 52 | Condensers 76 and 78 | Heated | House |
| 52 | Evaporators 72 and 74 | House | Ambient |

Figure 6:
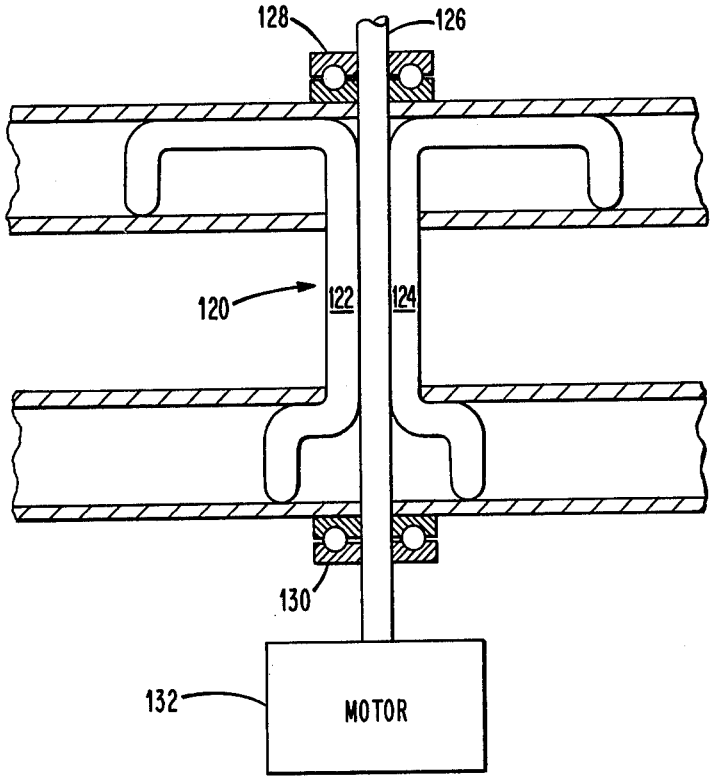
FIG. 6 is a schematic side elevation view of an embodiment of the invention illustrating an arrangement to support the heat pipes for rotation.

FIG. 6 shows an air conditioner/heat pump assembly 100 similar to that of FIGS. 1, 2, and 3 and illustrates one arrangement for supporting the heat pipes for rotation. The heat pipe assembly 120 includes heat pipes 122 and 124 rigidly attached to and supported by a shaft 126. The shaft 126 is supported for rotation in bearings 128 and 130 and is driven by a motor 132. The motor 132 is adapted for rotating the assembly 120 at a constant speed so as to effect the pressure differential to cause cooling.

Figure 7:
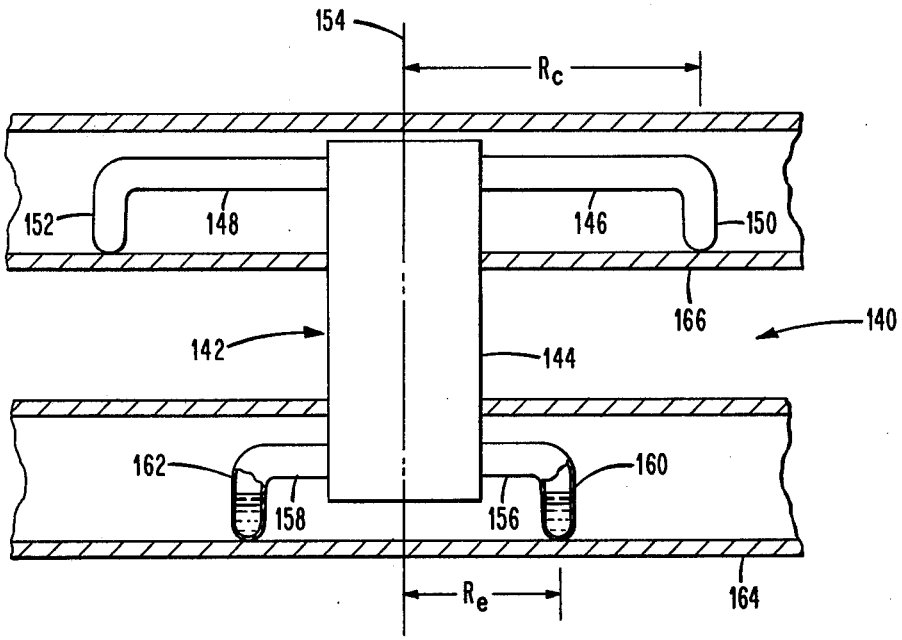
FIG. 7 is a schematic side elevation of an embodiment of the invention including a single heat pipe to which two or more evaporator and condenser legs are attached.

FIG. 7 is a schematic side elevation view of an easily fabricable alternate embodiment of the invention wherein an air conditioner/heat pump 140 comprises a heat pipe assembly 142 having a single rotatable central tube 144. Brazed or welded to the tube 144 are two or more radially extending arms 146 and 148 which connect the tube 144 to condenser legs 150 and 152 located at a distance $R_c$ from the axis 154 and an equal number of arms such as arms 156 and 158 which connect the tube 144 to evaporator legs 160 and 162 located at a distance $R_e$ from the axis 154. As in other embodiments described herein, the evaporator legs 160 and 162 are enclosed within a channel 164 and the condenser legs 150 and 152 are enclosed within a channel 166 which carry selected flows of air at different temperatures for contact with the legs.

An example of operation of the heat actuated air conditioner/heat pump disclosed herein will now be described with reference to FIGS. 1–5. This example will be directed to the use of sulfur dioxide, $SO_2$, as the working or refrigerant fluid and to operation of the system as an air conditioner. It will be assumed that the ambient temperature for heat rejection is 100° F. temperature. Thus, the system initially is isothermal at the 100° F. temperature. It will also be assumed that it is desired to cool the air for air conditioning purposes to 40° F. Under these conditions, the evaporating pressure in the evaporator leg is 26.6 psia and the condensing pressure in the condenser legs is 84.1 psia. The required rotational speed is determined by the condition that the pressure must be raised by rotation from 26.6 psia in the evaporator legs to 84.1 psia in the condenser legs.

Assuming that $R_c$, the distance of the condenser leg from the axis of rotation, is two feet and that $R_e$ is small enough with respect to $R_c$ to be neglected, the rotational velocity required can be calculated by conventional techniques. With sulfur dioxide as the working fluid, the required rotational velocity is 4725 RPM. For the recycle operation, condensation is desired at the ambient temberature of 100° F. In order to counteract the pressure differential produced by rotation, the condenser leg which now contains the liquid refrigerant must be heated to about 175° F. in order to transfer the vapor back to the evaporator leg. At this temperature the vapor pressure is 250 psia.

Straightforward calculations also lead to the conclusion that the rotational speed required is proportional to 1/M where M is the molecular weight of the working fluid. Thus, in order to keep the rotational speed low, the working fluid should have as high a molecular weight as possible, preferably at least 50. Also, the vapor pressure of the working fluid should be in a range high enough to provide desired heat transfer rates and low enough that the heat pipe walls can be rather thin. In addition, it is desirable that the ratio of heat of vaporization of the working fluid to its heat capacity be as large as possible so as to optimize the coefficient of performance obtained by the system. It is also preferred that the working fluid have low toxicity and be nonflammable so that cooled air or warmed air from the unit can be directly distributed to the house without special safety precautions.

Working fluids other than sulfur dioxide will give satisfactory performance—in fact sulfur dioxide may not be suitable for use in commercial systems because of its toxicity and its relatively low molecular weight (60). Freon 114B2, which has the chemical formula $CBrF_2CBrF_2$, is one of the best candidate working fluids. The bromine in this compound gives both a high molecular weight and high fluid density so as to minimize rotational speed and the fluid reservoir volume. Other fluids in the halogenated organic family such as Freon 318 ($C_4F_8$) and PP3 ($C_8F_{16}$) are also suited for this application, as are organic fluids containing bromine and hydrogen (e.g., $CH_2Br_2$).

Table 3 lists the approximate performance characteristics of several working fluids, showing the required rotational speed of the air conditioner/heat pump for $R_c$ equal to 2 feet, an ambient temperature of 100° F., and a desired cooling temperature of 40° F. It also lists the estimated cooling coefficient of performance (COP) achievable during operation of a system such as that of FIG. 6 as an air conditioner, where COP is defined as the cooling BTU's produced divided by the heat input BTU's required. Also listed is the parameter PER for heat pump operation, defined as heat delivered to house air divided by heat input from fuel, and calculated as 1.0 plus the cooling COP, less an assumed exhaust gas stack loss of fifteen percent of the input fuel energy.

TABLE 3

SYSTEM PERFORMANCE WITH DIFFERENT FLUIDS

| FLUID | RPM | COOLING COP | PER |
|---|---|---|---|
| $SO_2$ | 4725 | 0.94 | 1.65 |
| Freon 318 | 2450 | 0.65 | 1.40 |
| Freon 114B2 | 2150 | 0.76 | 1.50 |
| PP3 | 1730 | 0.70 | 1.44 |

It is thus seen that the objects of this invention have been achieved in that there has been disclosed an air conditioner/heat pump which runs substantially on heat energy as the input. This system eliminates the need for mechanical compressors or the inclusion of an adsorber material as in known refrigeration systems. The refrigerant or working fluid of the system is contained in individual sealed tubes with no internal moving parts, connections, or wall penetrations, and thus leak-tightness of the air conditioner/heat pump is easy to achieve and maintain. In addition, the air conditioner/heat pump disclosed herein is inexpensive to manufacture and reliable in operation.

It should be understood that modifications of the system disclosed herein will occur to those skilled in the art in view of this disclosure, and it is intended that all such modifications and variations be included within the scope of the appended claims.

What is claimed is:

1. A heat-actuated air conditioner/heat pump comprising:

a first heat pipe assembly including at least one sealed tube having a central portion in fluid communication with a condenser leg and an evaporator leg and adapted to carry a working fluid therein, said tube being rotatable about an axis lying substantially in said central portion, said condenser leg located at a radius $R_c$ from said axis of rotation, and said evaporator leg located at a radius $R_e$ from said axis of rotation, $R_c$ being greater than $R_e$ and $R_e$ being comparatively small;

a second heat pipe assembly substantially identical to said first heat pipe assembly, said second assembly being axially displaced from said first assembly and rotatable about said axis;

means for rotating said heat pipe assemblies about said axis to produce a vapor pressure differential of said fluid in the condenser and evaporator legs of each assembly, the speed of rotation being selected in conjunction with the molecular weight of the working fluid and the values for $R_c$ and $R_e$, such that evaporation of the working fluid in the evaporator legs will occur at a lower temperature than that which produces condensation of said fluid in the condenser legs; and means for providing separate flows of air at different temperatures and for selectively directing said flows onto the condenser legs and the evaporator legs of said heat pipe assemblies.

2. The air conditioner/heat pump according to claim 1, wherein said central portion is substantially straight and said condenser leg and said evaporator leg are substantially parallel to said central portion and are adapted to hold said working fluid.

3. The air conditioner/heat pump according to claim 1, wherein each of said heat pipe assemblies includes a pair of sealed tubes disposed symmetrically about said axis of rotation to provide dynamic balance during rotation of said assemblies.

4. The air conditioner/heat pump of claim 1 wherein said working fluid is a halogenated organic fluid.

5. The air conditioner/heat pump according to claim 3 wherein said working fluid is Freon 114B2 having the chemical formula $CBrF_2CBrF_2$.

6. The air conditioner/heat pump according to claim 1 wherein said means for providing separate flows of air and for directing said flows onto said condenser legs and said evaporator legs comprises:

first and second channels enclosing, respectively, the evaporator and condenser legs of said first heat pipe assembly, and third and fourth channels enclosing, respectively, the evaporator and condenser legs of said second heat pipe assembly, each of said channels operable to carry and direct a separate flow of air onto its associated leg.

7. The air conditioner/heat pump according to claim 11 further including means for switching each of said separate flows from one to another of said channels.

8. The air conditioner/heat pump according to claim 1 wherein each of said heat pipe assemblies includes a single rotatable tube centered on said axis and in fluid communication with a plurality of condenser legs and a plurality of evaporator legs each disposed symmetrically about said axis to provide dynamic balance during rotation of said assemblies.

9. The air conditioner/heat pump according to claim 7 wherein said means for switching said separate flows includes a plurality of valves operable to switch the flows carried by said first, second, third, and fourth channels to said third, fourth, first, and second channels, respectively, to permit cycling of each heat pipe assembly between a first mode wherein working fluid is transferred from the evaporator leg to the condenser leg of said heat pipe assembly and a second mode wherein working fluid is transferred from the condenser leg to the evaporator leg of said heat pipe assembly.

* * * * *